US007011538B2

(12) United States Patent
Chang

(10) Patent No.: US 7,011,538 B2
(45) Date of Patent: Mar. 14, 2006

(54) DUAL INPUT CHARGER WITH CABLE STORING MECHANISM

(75) Inventor: Chi-Lin Chang, Taipei (TW)

(73) Assignee: Elementech International Co., Ltd., Taipei (TW)

( * ) Notice: Subject to any disclaimer, the term of this patent is extended or adjusted under 35 U.S.C. 154(b) by 0 days.

(21) Appl. No.: 10/857,833

(22) Filed: Jun. 2, 2004

(65) Prior Publication Data

US 2005/0272287 A1 Dec. 8, 2005

(51) Int. Cl.
*H01R 13/72* (2006.01)
*H01R 29/00* (2006.01)

(52) U.S. Cl. ..... 439/172; 439/501

(58) Field of Classification Search ..... 439/135, 439/4, 501, 218, 171, 172, 131; 362/258
See application file for complete search history.

(56) References Cited

U.S. PATENT DOCUMENTS 1,153,829 A * 9/1915 Rueckert ..... 242/377
2,938,110 A * 5/1960 Busch et al. ..... 362/258
5,455,751 A * 10/1995 Lynch et al. ..... 362/194
5,797,558 A * 8/1998 Peterson et al. ..... 242/373
5,829,993 A * 11/1998 Wu ..... 439/131
5,901,056 A * 5/1999 Hung ..... 363/142
6,077,109 A * 6/2000 Prazoff ..... 439/501
D486,788 S * 2/2004 Riede ..... D13/108
6,780,047 B1 * 8/2004 Laity et al. ..... 439/501
6,790,062 B1 * 9/2004 Liao ..... 439/171

FOREIGN PATENT DOCUMENTS

TW 486187 5/2002

* cited by examiner

*Primary Examiner*—Neil Abrams

(57) ABSTRACT

A charger capable of converting either alternating current or direct current power source, with a cable storing mechanism, is disclosed. The device includes a main body to incorporate other components, an in-car connecting component which can be connected to the cigarette lighter of a car, a house connecting component which can be connected to the AC receptacle, and a cable storing device having a spiral structure to smoothly store the charging cable. Because the dual input charger is so compact that a consumer can carry easily the charger and to choose either the in-car connecting component or the house connecting component, depending on the conditions he faces with. When the charging is finished, a consumer can readily grasp and rotate the charger to sequentially wind the charging cable into the continuous spiral groove of the cable storing device.

20 Claims, 7 Drawing Sheets

DUAL INPUT CHARGER WITH CABLE STORING MECHANISM

BACKGROUND OF THE INVENTION

The present invention relates in general to a charger, and more particularly, to a dual input charger with a cable storing mechanism.

Owing to the prosperity of commercial transaction, the information communicated between people has become more important than ever. Further, because the mobile business is common to people nowadays, the percentage of people possessing mobile phones, personal digital assistants (PDA), digital cameras, and laptop computers has been rapidly increased. To convince people to utilize the mobile business system, the most important thing except the quality of the communication signal is the working time of the battery providing power. Although the battery manufacturers continually work on the invention of a long-term battery, the working time of a battery is always limited. A battery needs to be recharged.

The chargers used for mobile business, according to their different external power source, can be divided into two different groups, the in-car charger and the house charger. The in-car charger has an electrical plug to connect it to the cigarette lighter of a car. The house charger has two metal blades to connect it to the alternating current (AC) receptacle of a house. However, these two different type chargers are always manufactured and sold independently. It is expensive for a consumer to buy both types of the chargers. It is also inconvenient for a consumer to carry two chargers.

Further, most consumers leave the charging cable tangled together when the charger is not in use. Some consumers wrap the charging cable directly around the external surface of the charger or collect the charging cable by folding. These storage methods always damage the inner electrical strands and therefore reduce the lifetime of the charging cable. Consumers are unlikely to notice these damages. Only if they fail to charge their battery for many times, can they notice their charger having problem. It is really troublesome for consumers.

A Taiwan patent with publication numbere 486187 discloses to remedy this problems. However, it was unsuccessful. According to the structure of the disclosure, its metal blades for connecting to the AC receptacle need to be pulled out by one's finger in order to be utilized. Because the space permitting the finger of a consumer to pull out the metal blades is quite small, it is difficult to utilize the invention in accordance with the patent. In addition, the cable storage method provided by the patent is to fold the charging cable. The possibility of fracture of the inner electrical strands still exits.

BRIEF SUMMARY OF THE INVENTION

The present invention provides a dual input charger with cable storing mechanism. It remedies the long-standing problem that consumers have to prepare at least two chargers to use different external electrical sources. It also resolves the problem that the charging cable is not properly stored, and the nuisance that the charger does not work because of the fracture of the charging cable.

The dual input charger provided by the present invention includes a main body to incorporate other components, an in-car connecting component which can be connected to the cigarette lighter of a car, a house connecting component which can be connected to the AC receptacle, a cable storing device having a spiral structure to smoothly store the charging cable. Because the in-car connecting component and the house connecting component are incorporated into the main body, a consumer can choose either the in-car connecting component or the house connecting component to connect the charger to external electrical source, depending on the condition he faces. When the charging is finished, by means of the guidance of the sleeve component a consumer can readily grasp and rotate the charger to sequentially wind the charging cable into the continuous spiral groove of the cable storing device. The dual input charger is simple to operate, and easy to carry, it also has a pretty appearance.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
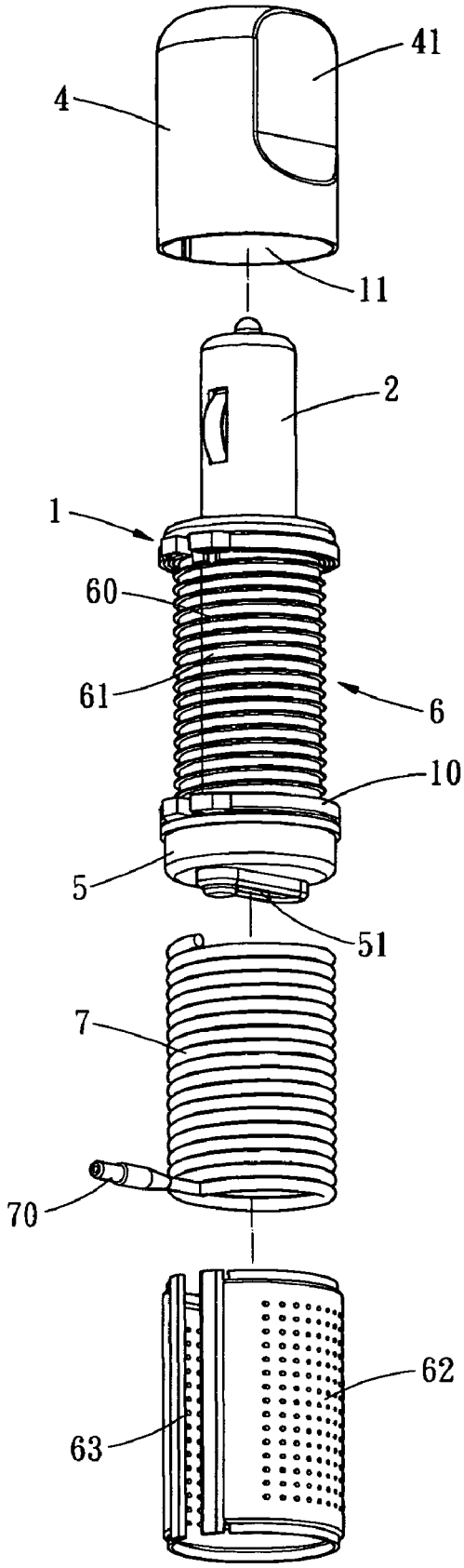
FIG. 1 is an exploded perspective view of one embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Referring to FIG. 1 through 4, a preferred embodiment of a dual input charger with cable storing mechanism in accordance with the present invention is shown. The charger includes a main body 1 incorporating all other components for easy carrying, an in-car connecting component 2 used to connect the charger to the cigarette lighter of a car, a house connecting component 3 used to connect the charger to the AC receptacle of a house, a grasping and rotating cap 4 enclosing the in-car connecting component 2, a flat cap 5 enclosing the house connecting component 3, and a cable storing device 6 facilitating the winding of the charging cable.

The main body 1, as shown in FIG. 1 through 4, includes a shell body 10 which can be formed directly into a cylinder as shown in FIG. 1, and therefore provides a hollow inner space to install the charging circuit and a cylindrical external surface to accommodate the cable storing device 6 to proceed the winding and storing of the charging cable 7. However, it should be exactly understand that the shell body 10 is not limited to cylinder, it can be formed into other shapes. At one end of the shell body 10, a first storeroom 11 fitting with the grasping and rotating cap 4 is provided to store the in-car connecting component 2. At the other end of the shell body 10, a second storeroom 12 fitting with the flat cap 5 is provided to store the house connecting component 3.

Figure 3:
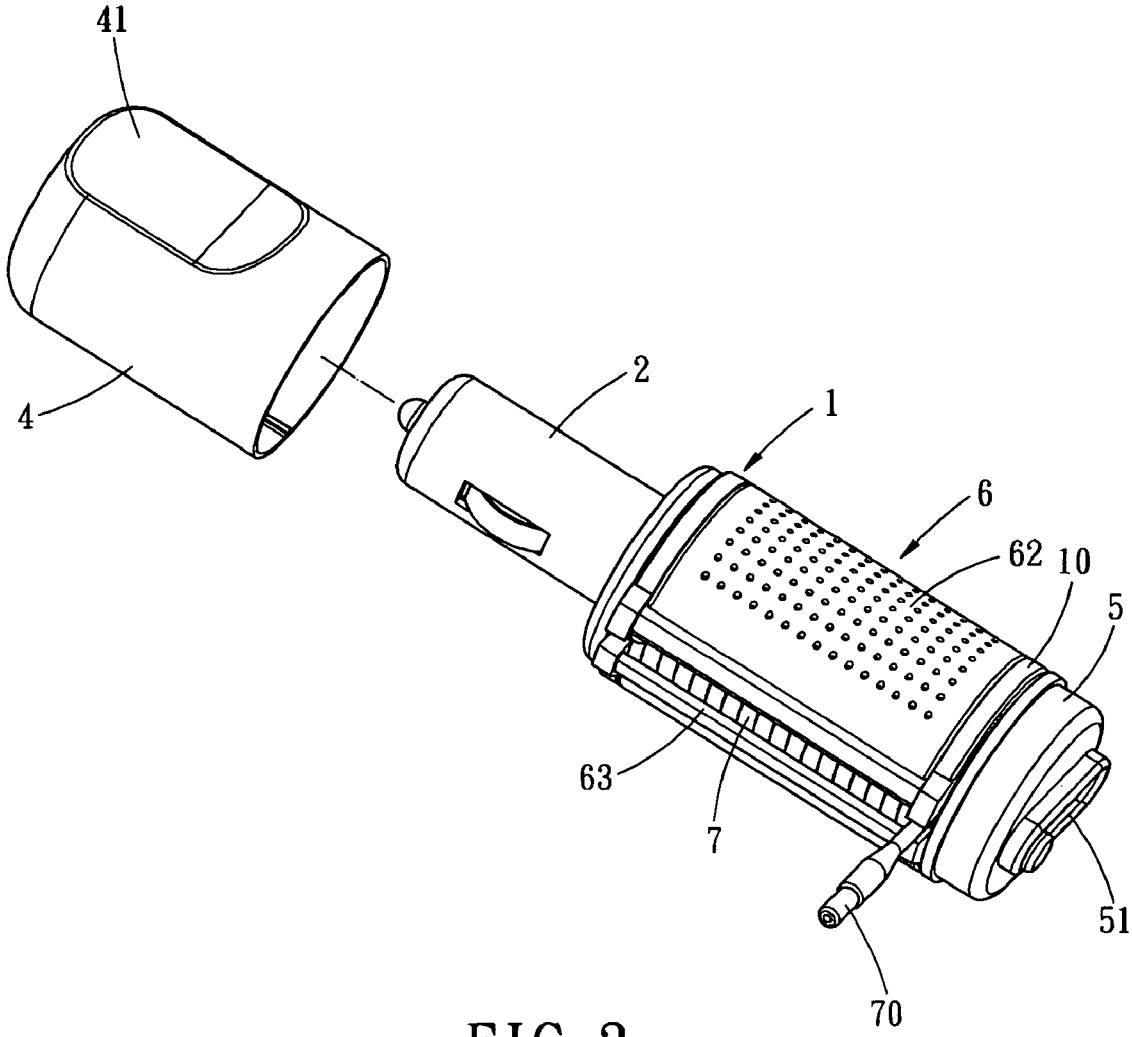
FIG. 3 is a perspective view of one embodiment of the present invention, showing a condition wherein a cap is removed to disclose the in-car connecting component.

The outer boundary of the first storeroom 11 is formed by the grasping and rotating cap 4 pressed onto the corresponding end of the main body 1. The grasping and rotating cap 4 provides two opposite concave grasping portions 41 which can be grasped by a consumer to rotate the cap 4 together with the main body 1. Because the grasping and rotating cap 4 is directly pressed onto the corresponding end terminal on the main body 1, a consumer can open readily the grasping and rotating cap 4 and connect the in-car connecting component 2 to external electrical source, as is illustrated in FIG. 3. The grasping and rotating cap 4 can further be pressed onto the opposite end of the main body 1 to prevent it from missing caused by inadvertently putting it aside.

Figure 4:
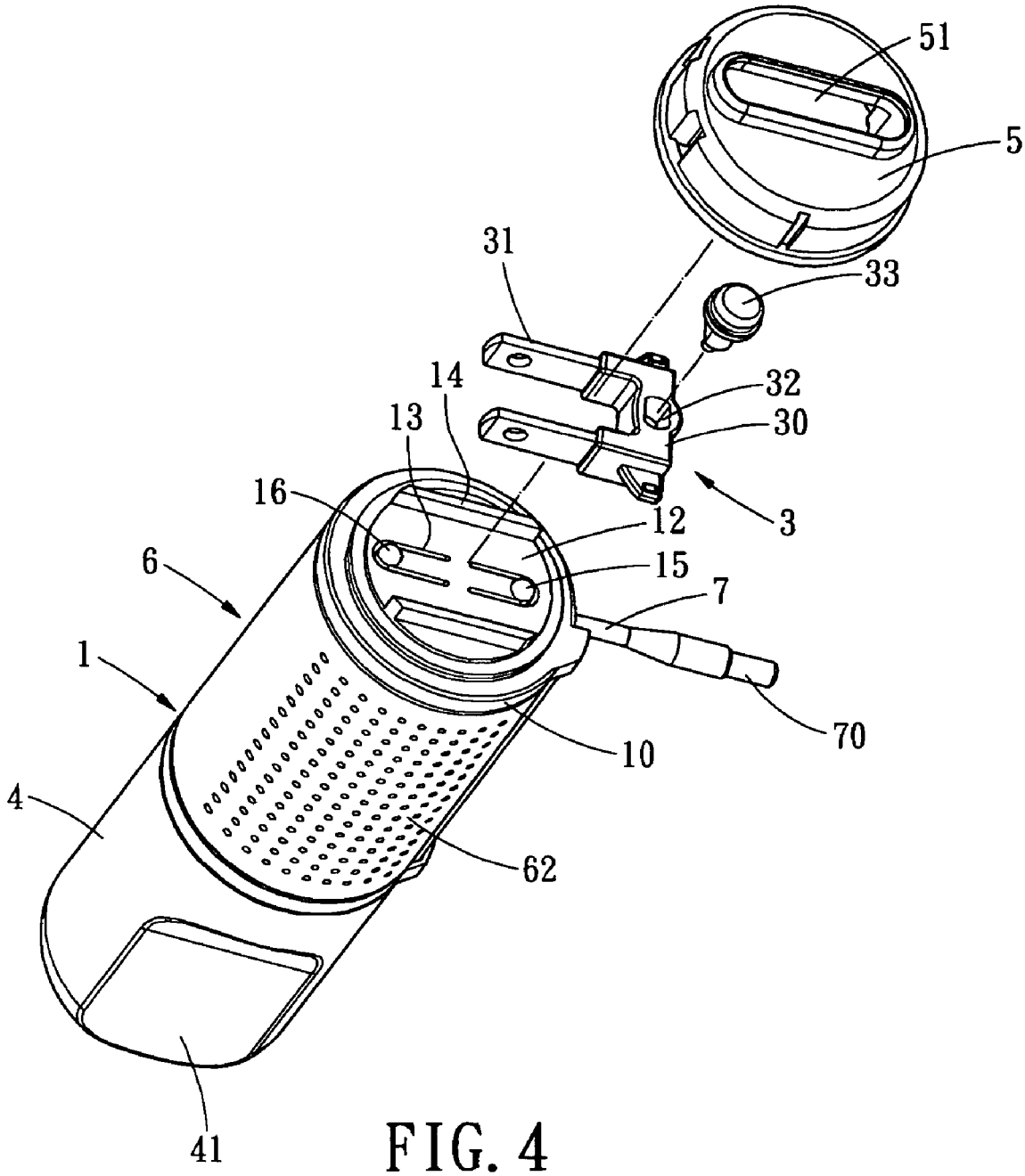
FIG. 4 is an exploded perspective view of a second storeroom and the house connecting component.

The second storeroom 12, as shown in FIG. 4, has an outer boundary formed by the flat cap 5 having a slot opening 51, and a concave receptacle 13. The receptacle 13 includes a pair of parallel slide track 14 along which the house connecting component 3 can be slid in or out, a front positioning point 15 provided to locate the house connecting component 3 in the stored condition, a rear positioning point 16 provided to locate the house connecting component 3 in the utilized condition.

The house connecting component 3 includes a base 30 with two metal blades and a positioning hole 32 bored through the base 30, and a push button 33 pivotally installed into the positioning hole 32, matching with the slot opening 51 with its head slightly protruding above the slot opening 51 and being confined to the slot opening 51 within which the push button 33 can only be pushed back and forth. Pressing the push button 33 can discharge the positioning hole 32 from the front or rear positioning points 15, 16. By means of the push button 33 and the slide track 14, the house connecting component 3 can be stored at the front positioning point 15, or be pushed out and stuck at the rear positioning point 16 for charging.

The cable storing device 6, as shown in FIG. 1, includes a cable storage reel 60 built directly on the external surface of the main body 1, adapting a single thread screw structure and having a continuous spiral groove 61 thereon, and a sleeve component 62 which can be sleeved onto the cable storage reel 60 and rotated freely, having a guidance slot 63 cut from it to fit the lateral displacement of the end terminal 70 when the charging cable 7 is pulled out from the cable storage reel 60 for charging. The charging cable 7 and the charging circuit connect with each other at the front end of the cable storage reel 60. The guidance slot 63 permits only one thread to be winded into the cable storage reel 60 and provides a guiding effect for winding.

Figure 2:
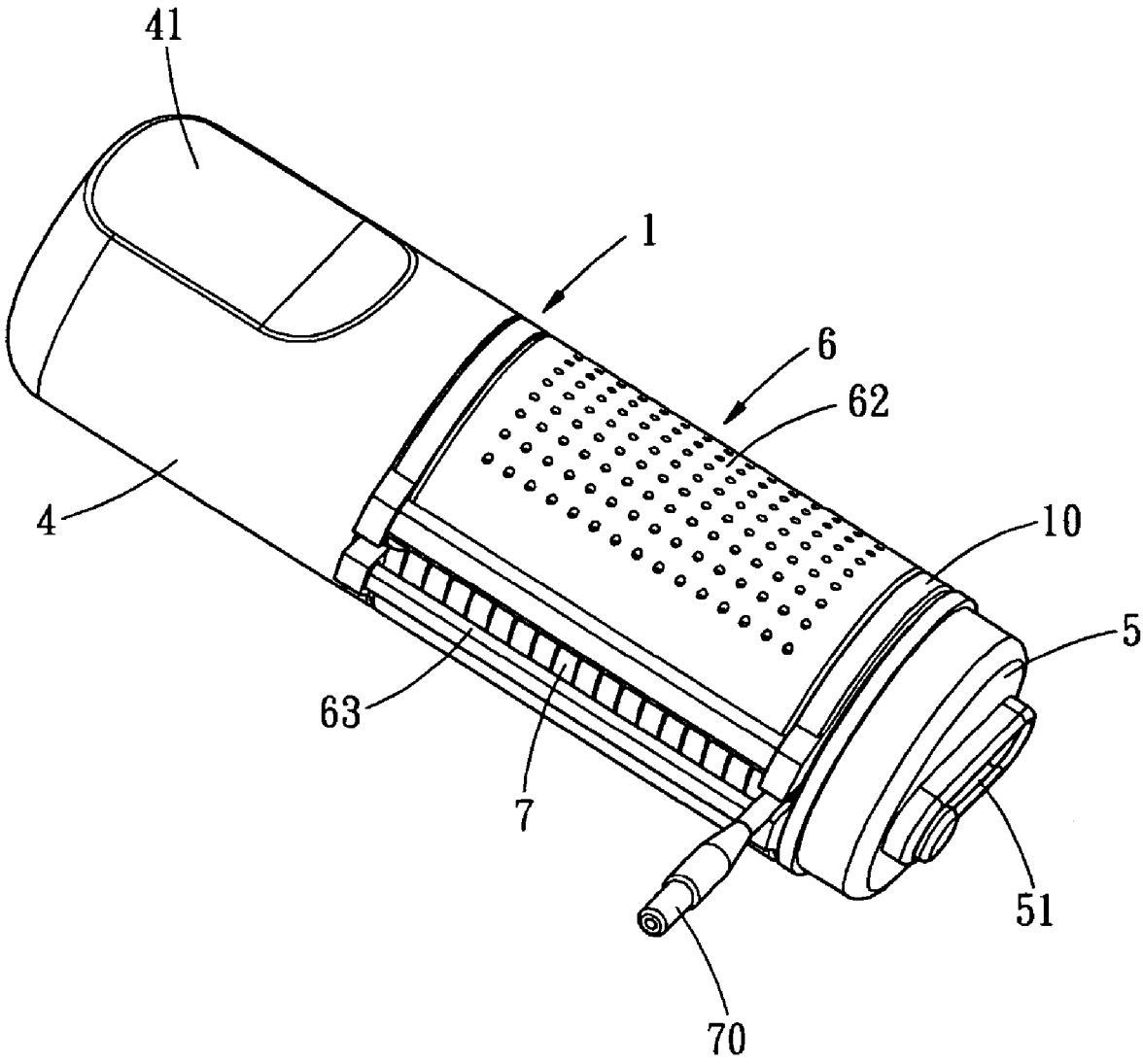
FIG. 2 is a perspective view of one embodiment of the present invention fully assembled.

The complete combination in accordance with the embodiment of the present invention is shown in FIG. 2. The actual operation and the mutual coordination between each components of the charger are illustrated in FIG. 3 through 7.

It is pretty convenient for a consumer to carry the charger and to choose either the in-car connecting component 2 or the house connecting component 3, depending on the conditions he faces with, because the in-car connecting component 2 and the house connecting component 3 are enclosed respectively into the storeroom 11 and the storeroom 12 of the main body 1.

Figure 5:
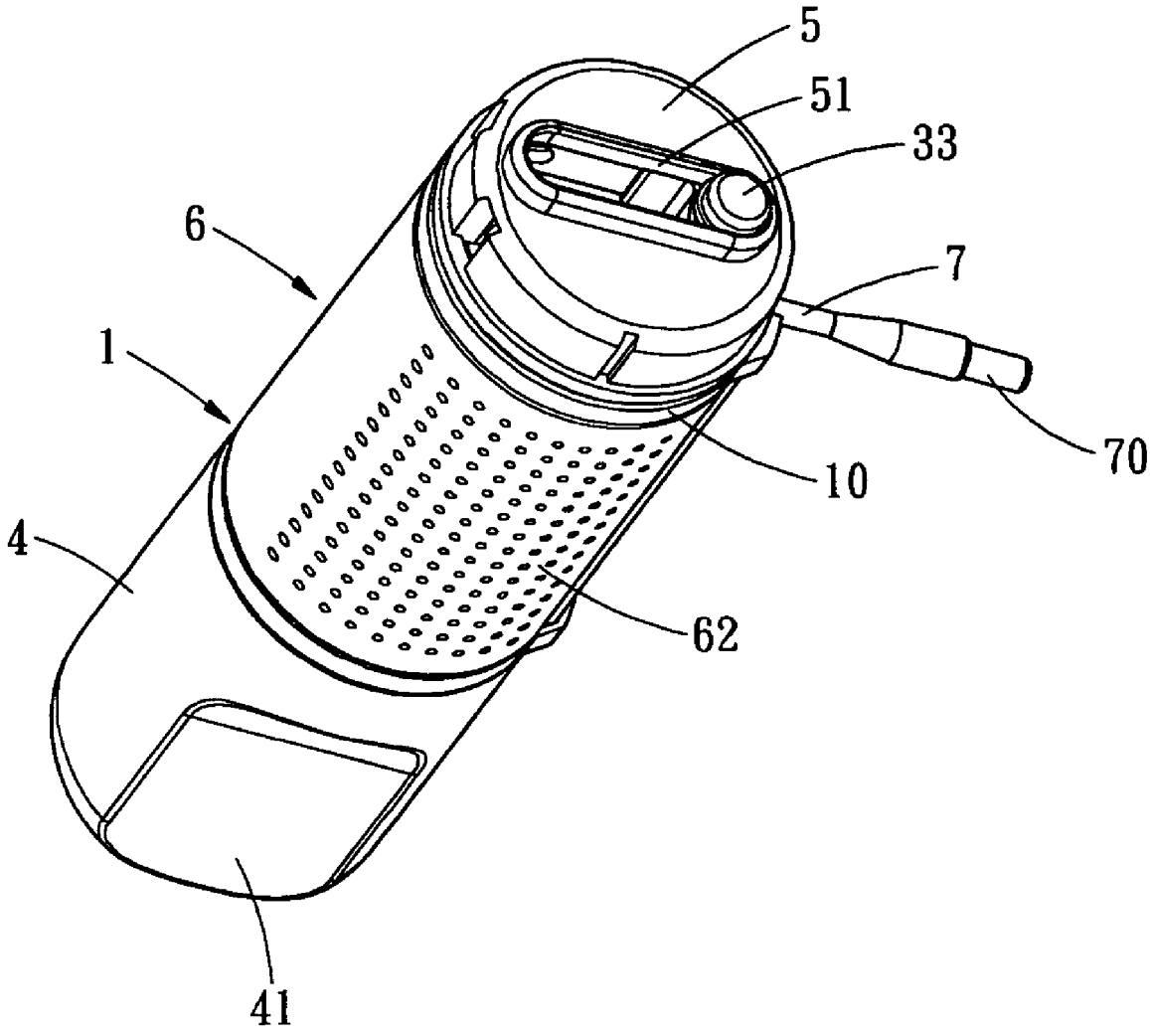
FIG. 5 is a perspective view of one embodiment of the present invention, showing a condition wherein a house connecting component is stored inside.
Figure 6:
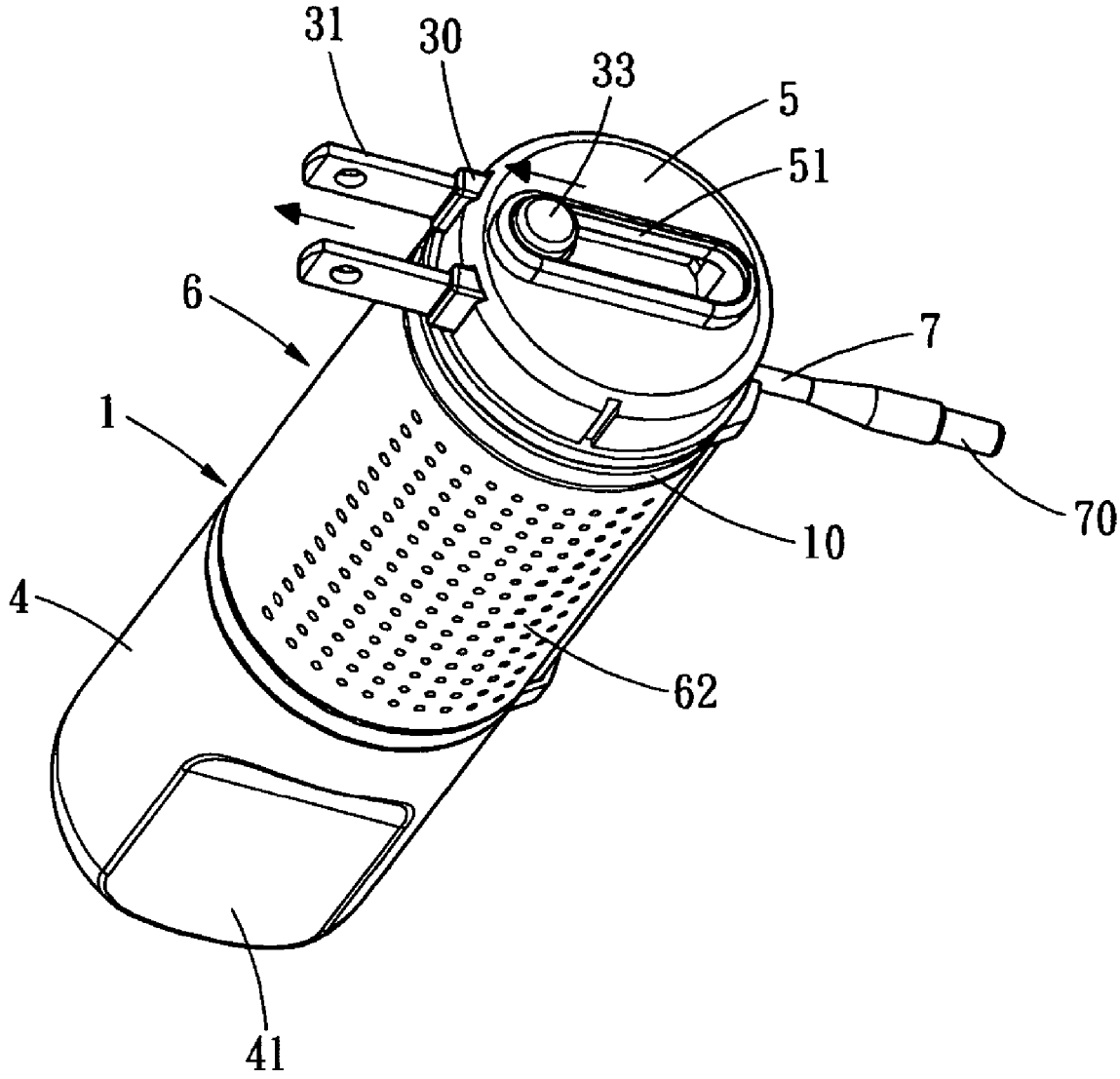
FIG. 6 is a view similar to FIG. 5, but showing a condition wherein the house connecting component is pushed outside for use.
Figure 7:
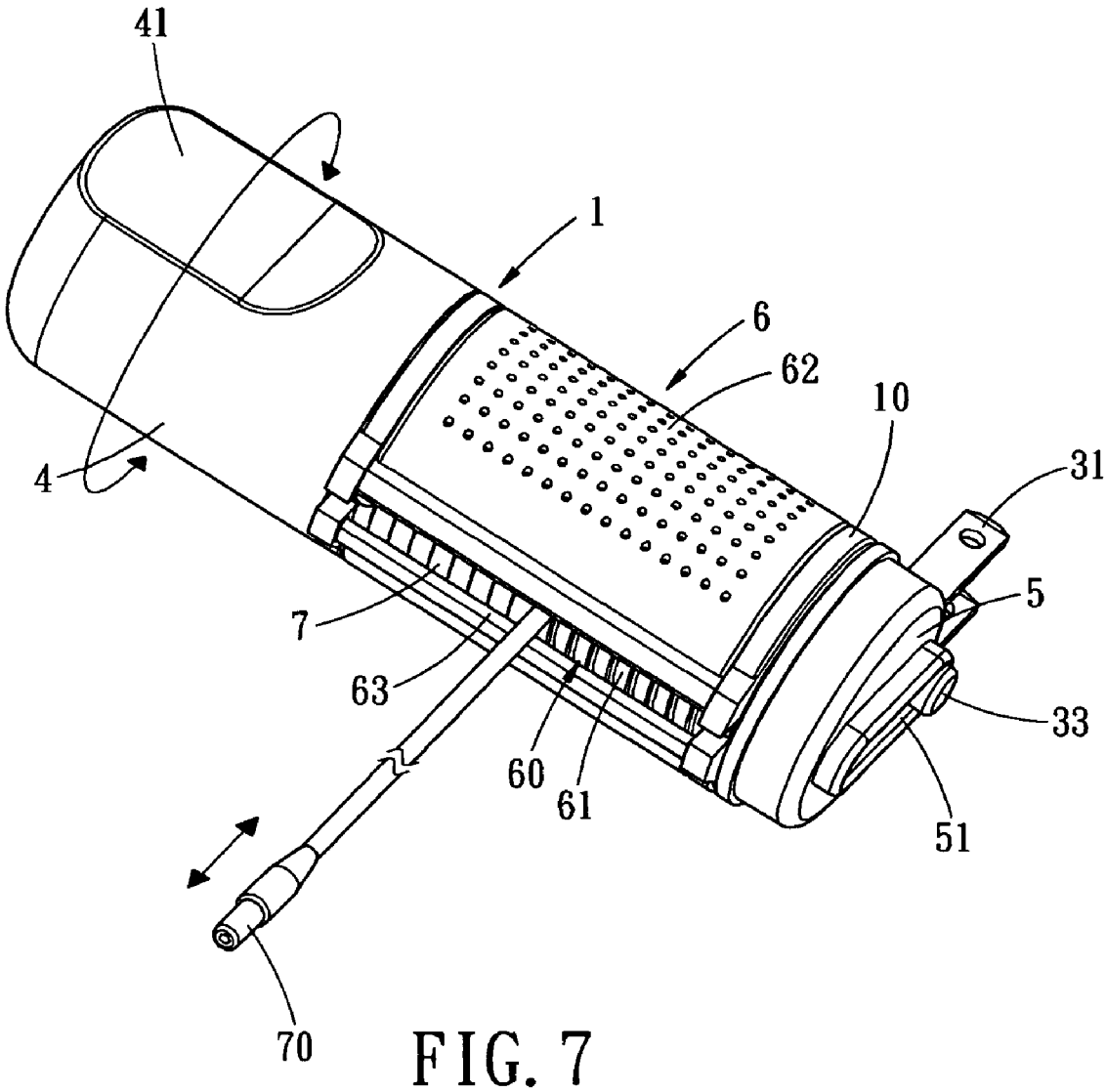
FIG. 7 is a perspective view of one embodiment of the present invention, illustrating the winding operation of a cable storing device.

To use the in-car connecting component 2, a consumer can simply remove the grasping and rotating cap 4 to disclose the in-car connecting component 2, plug the in-car connecting component 2 directly into the cigarette lighter socket of a car to acquire the charging power, pull out the charging cable 7 from the cable storage reel 60, and plug the end terminal 70 of the charging cable 7 into the input socket of a mobile business device. To use the house connecting component 3, a consumer slightly presses the push button 33 to discharge the base 30 from the positioning point 15, pushes out the house connecting component 3 from the second storeroom 12, and plug the metal blades of the house connecting component 3 into the AC receptacle of a house, as is illustrated in FIG. 5.

When the charging is complete, a consumer either presses the grasp and rotate cap 4 onto the end of the main body 1 or pushes the house connecting component 3 back to the front positioning point 15, and then starts to wind the charging cable 7 by means of the cable storing device 6. A consumer can hold the sleeve component 62 by his left hand, grasp and rotate the grasp and rotate cap 4 by his right hand. Utilizing the continuous spiral structure of the cable storage reel 60 and the slot opening 63 which permits only one thread to pass into the cable storage reel 60, the rotational operation can sequentially wind the charging cable 7 into the continuous spiral groove 61 of the cable storage reel 60. The charging cable 7 is therefore stored orderly inside the cable storing device 6 and is protected by the sleeve component 62. Consequently, the present invention extends substantially the lifetime of the charging cable 7.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A dual input charger, comprising:

a main body with a charging circuit;

an in-car connecting component installed on the main body, connected with the charging circuit;

a house connecting component installed on the main body, connected with the charging circuit;

a cable storing device installed on the main body, having a cable storage reel built directly on an external surface of the main body and a sleeve component sleeved onto the cable storage reel and rotated freely; and a charging cable connected to the charging circuit at one end of the cable storage reel.

2. The dual input charger of claim 1, further comprising a grasping and rotating cap engaged with the main body to provide a first storeroom formed inside for storing the in-car connecting component.

3. The dual input charger of claim 2, wherein the grasping and rotating cap provides two opposite concave grasping portions which can be grasped by a consumer to rotate the grasping and rotating cap together with the main body to wind the charging cable.

4. The dual input charger of claim 1, further comprising a flat cap engaged with the main body to provide a second storeroom formed inside for storing the house connecting component.

5. The dual input charger of claim 4, further comprising a concave receptacle formed on the main body and located in the second storeroom, which includes a pair of parallel slide track along which the house connecting component can be slid in or out.

6. The dual input charger of claim 5, wherein the concave receptacle has a front positioning point provided to locate the house connecting component in a stored condition, and a rear positioning point provided to locate the house connecting component in an utilized condition.

7. The dual input charger of claim 6, wherein the house connecting component has a base with two metal blades and a positioning hole bored through the base to fit with the front and rear positioning points.

8. The dual input charger of claim 7, wherein the house connecting component has a push button installed into the positioning hole, matching with and slightly protruding above the flat cap.

9. The dual input charger of claim 8, wherein the flat cap has a slot opening formed thereon to match with the push button and to confine the push button slid back and forth within by pressing the push button in discharge the positioning hole from the front or the rear positioning points.

10. The dual input charger of claim 1, wherein the main body 1 includes a shell body formed directly into a cylinder so that a hollow inner space is provided to install the charging circuit and a cylindrical external surface is provided to accommodate the cable storing device to proceed winding and storing of the charging cable.

11. The dual input charger of claim 10, wherein the in-car connecting component is installed at one distal end of the shell body and the house connecting component is installed at the other distal end of the shell body.

12. The dual input charger of claim 1, wherein the charging cable has one end connected to the cable storage reel and the other end formed an end terminal, the cable storage reel adapts a single thread screw structure to has a continuous spiral groove formed on the external surface of the main body, and the sleeve component has a guidance slot to fit a lateral displacement of the end terminal when the charging cable is pulled out from the cable storage reel for charging and to permit only one thread of the charging cable to be winded into the cable storage reel so as to provide a guiding effect for winding.

13. A dual input charger, comprising:

a main body with a charging circuit;

an in-car connecting component installed on the main body, connected with the charging circuit;

a house connecting component installed on the main body, connected with the charging circuit;

a cable storing device installed on the main body, having a cable storage reel and a sleeve component sleeved onto the cable storage reel;

a charging cable connected to the charging circuit at one end of the cable storage reel;

a flat cap engaged with the main body to provide a first storeroom formed inside for storing the house connecting component; and a concave receptacle formed on the main body and located in the first storeroom, which includes a pair of parallel slide track along which the house connecting component can be slid in or out wherein the concave receptacle has a front positioning point provided to locate the house connecting component in a stored condition, and a rear positioning point provided to locate the house connecting component in an utilized condition, and wherein the house connecting component has a base with two metal blades and a positioning hole bored through the base to fit with the front and rear positioning points.

14. The dual input charger of claim 13, wherein the house connecting component has a push button installed into either the front or the rear positioning hole, matching with and slightly protruding above the flat cap.

15. The dual input charger of claim 13, wherein the flat cap has a slot opening formed thereon to match with the push button and to confine the push button slid back and forth within.

16. A dual input charger, comprising:

a main body with a charging circuit;

an in-car connecting component installed on the main body, connected with the charging circuit;

a house connecting component installed on the main body, connected with the charging circuit;

a cable storing device installed on the main body, having a cable storage reel and a sleeve component sleeved onto the cable storage reel; and a charging cable connected to the charging circuit at one end of the cable storage reel, wherein the main body comprises a shell body formed directly into a cylinder so that the in-car connecting component is installed at one distal end of the shell body and the house connecting component is installed at the other distal end of the shell body.

17. The dual input charger of claim 16, wherein the shell body includes a hollow inner space to install the charging circuit and a cylindrical external surface to accommodate the cable storing device to proceed winding and storing of the charging cable.

18. The dual input charger of claim 16, wherein the cable storage reel is built directly on an external surface of the main body and a sleeve component sleeved onto the cable storage reel and rotated freely with respect to the main body.

19. The dual input charger of claim 16, wherein the charging cable has one end connected to the cable storage reel and the other end formed an end terminal, the cable storage reel adapts a single thread screw structure to has a continuous spiral groove formed on an external surface of the main body, and the sleeve component has a guidance slot to fit a lateral displacement of the end terminal when the charging cable is pulled out from the cable storage reel for charging and to permit only one thread of the charging cable to be winded into the cable storage reel so as to provide a guiding effect for winding.

20. The dual input charger of claim 16, wherein the in-car connecting component is located along an axial direction of the cylindrical shell body and the house connecting component can slidably move along a radial direction of the cylindrical shell body.

* * * * *